United States Patent [19]

Schafer

[11] Patent Number: 4,783,007

[45] Date of Patent: Nov. 8, 1988

[54] SPRAY DEVICE

[76] Inventor: Richard J. Schafer, 12 Roberts St., Victoria, Australia

[21] Appl. No.: 71,029

[22] Filed: Jul. 8, 1987

[30] Foreign Application Priority Data

Jul. 22, 1986 [AU] Australia ..... PH7070

[51] Int. Cl.[4] ..... B05B 3/04

[52] U.S. Cl. ..... 239/381; 239/553.5

[58] Field of Search ..... 239/380, 381, 553.5, 239/DIG. 5, 447–449, 382, 383

[56] References Cited

U.S. PATENT DOCUMENTS

| | | | |
|---|---|---|---|
| 885,902 | 4/1908 | Wooding | 239/DIG. 5 |
| 2,333,767 | 11/1943 | Davis | 239/449 |
| 2,950,063 | 8/1960 | Ripley, Jr. | 239/553.5 |
| 3,004,719 | 10/1961 | Pouppirt, Jr. | 239/381 |
| 3,111,273 | 11/1963 | Mei | 239/447 |
| 4,089,471 | 5/1978 | Koenig | 239/381 |
| 4,275,843 | 6/1981 | Moen | 239/570 |
| 4,291,835 | 9/1981 | Kaufman | 239/381 |
| 4,489,914 | 12/1984 | Stevenson et al. | 239/587 |

FOREIGN PATENT DOCUMENTS 631653 11/1949 France .

*Primary Examiner*—Andres Kashnikow
*Assistant Examiner*—Michael J. Forman

[57] ABSTRACT

A spray device is shown which has an inlet 14, a spray chamber 20 and a spray plate 16. The spray plate 16 has a plurality of apertures 18 and the chamber 20 accommodates a plurality of bodies 22 to disrupt the flow of water from the apertures 18 to provide a continuing changing spray pattern.

6 Claims, 3 Drawing Sheets

SPRAY DEVICE

BACKGROUND OF THE INVENTION

This invention relates to a spray device and in particular, but not exclusively, to a spray device for providing a decorative spray pattern for use in fountains, ponds or the like. It is also conceivable that the spray device could be used for gardening or the like.

Conventional spray devices which are used in fountains and ponds to provide a decorative spray pattern are generally limited to a single pattern. Some devices have been made which enable different spray heads to be utilized to provide different patterns. However, in all of these systems the pattern is constant and therefore, from an asthetic point of view, tends to become boring after a certain amount of time.

The object of this invention is to provide a spray device which can provide a continually changing spray pattern for use with fountains and ponds etc.

SUMMARY OF THE INVENTION

The invention may be said to reside in a spray device, said spray device having an inlet communicating with a spray chamber, said spray chamber having a plurality of apertures for enabling water to be sprayed out from said spray chamber, said spray chamber accommodating a plurality of bodies for circulation within said chamber as water passes through the chamber from the inlet to the plurality of apertures to thereby disrupt the flow of water through the chamber and cause a continually changing spray pattern to be sprayed from said apertures.

In a preferred embodiment of the invention the plurality of bodies have different masses and comprise ball bearings of different sizes to thereby provide the plurality of bodies having different masses. However, in other embodiments the bodies could be the same size and made from different materials to provide the plurality of bodies having different masses.

Preferably, the plurality of apertures are formed in an upper wall of the spray device and said upper wall is convex (with respect to the outside) or some other shape depending on the shape of the bodies.

DESCRIPTION OF THE PREFERRED EMBODIMENTS

Preferred embodiments of the invention will be described with reference to the accompanying drawings in which.

Figure 1:
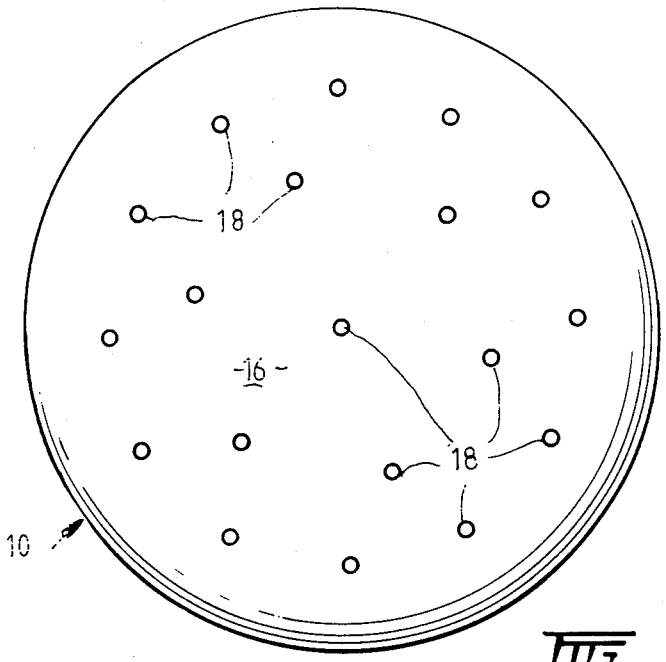
FIG. 1 is a top view of a spray device embodying the invention.
Figure 2:
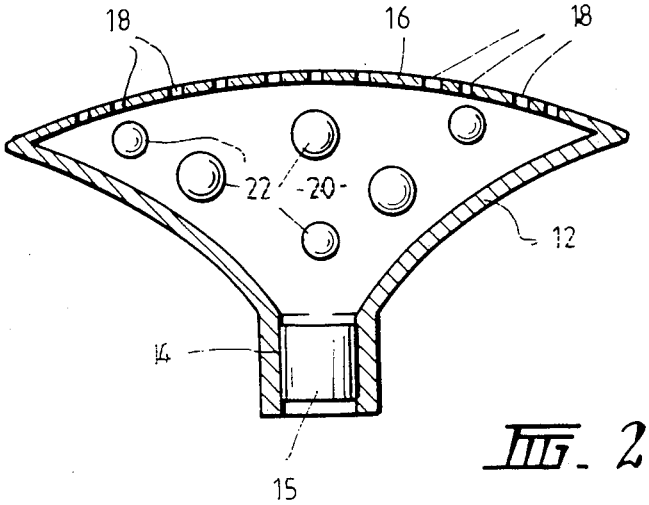
FIG. 2 is a cross-sectional view of the spray device of FIG. 1.

With reference to FIGS. 1 and 2, a spray device 10 is shown which comprises an annular funnel like member 12 which tapers outwardly from its lower extremity to its top extremity. The lower extremity is provided with an inlet 14 which is adapted to be connected to a supply of water and the upper extremity is provided with a spray plate 16 provided with a plurality of apertures 18. As is clearly seen in FIG. 3 the spray plate 16 is convex with respect to the outside.

The funnel like member 12 and the spray plate 16 define a spray chamber 20 in which a plurality of bodies 22 are located. The bodies may be of any particular shape and in the embodiment shown in FIGS. 1 and 2 are spherical. The bodies 22 have different masses which can be provided by forming the bodies from different materials or from forming the bodies of different sizes from the same material.

When water is forced into the inlet 14 under pressure so that it fills the spray chamber 20, the water is sprayed from the apertures 18 and the bodies 22 are circulated within the chamber 20 due to the movement of water from the inlet 14 to the apertures 18. The bodies therefore disrupt the flow of water and tend to block some of the apertures 18 in a random fashion. This results in a continually changing spray pattern emanating from the apertures 18 which is interesting to watch. point of view. Since the bodies 22 are circulated within the chamber 20 in a random fashion, the spray pattern emanating from the apertures 18 continually changes in a random pattern and does not merely repeat itself after a certain amount of time.

The inlet 14 may include a pressure control valve 15 to limit the pressure of water entering the chamber 20. Preferably the valve limits pressure to 15–20 p.s.i. The volume of water entering the chamber is preferably controlled, having regard to the volume of the chamber, the size and number of apertures 18, so that the bodies 22 continuously circulate within the chamber 20.

Figure 3:
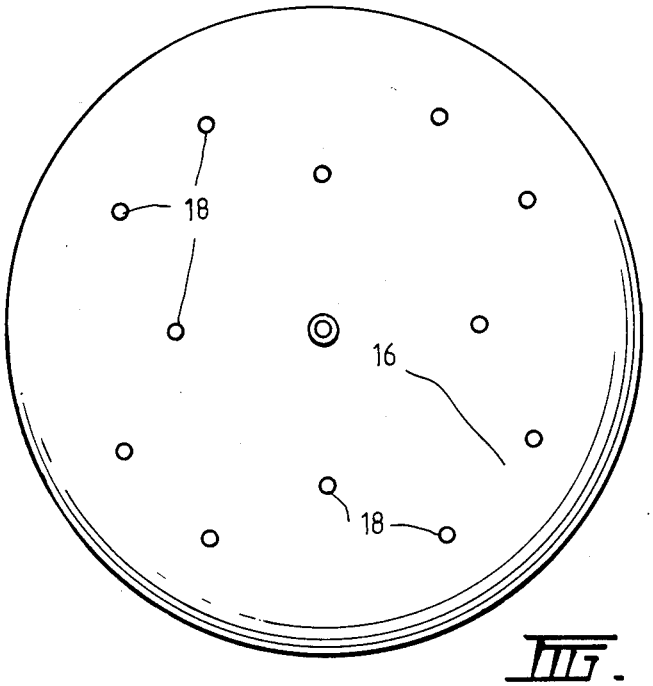
FIG. 3 is a top view of a second embodiment of the invention.
Figure 4:
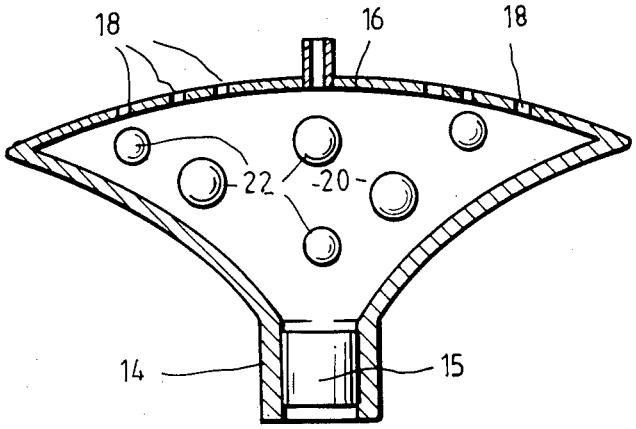
FIG. 4 is a cross-sectional view of the embodiment of FIG. 3.

The embodiment shown in FIGS. 3 and 4 is similar to that described with reference to FIGS. 1 and 2 except a different arrangement of apertures 18 is provided.

Figure 5:
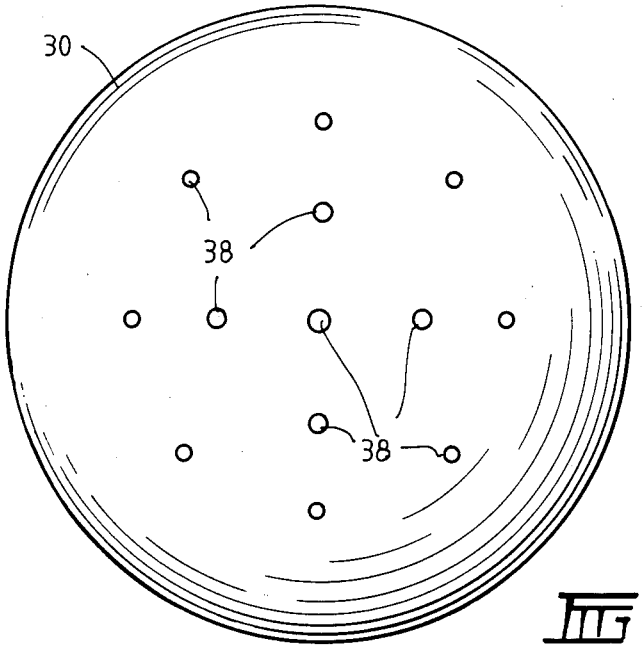
FIG. 5 is a top view of a third embodiment of the invention.
Figure 6:
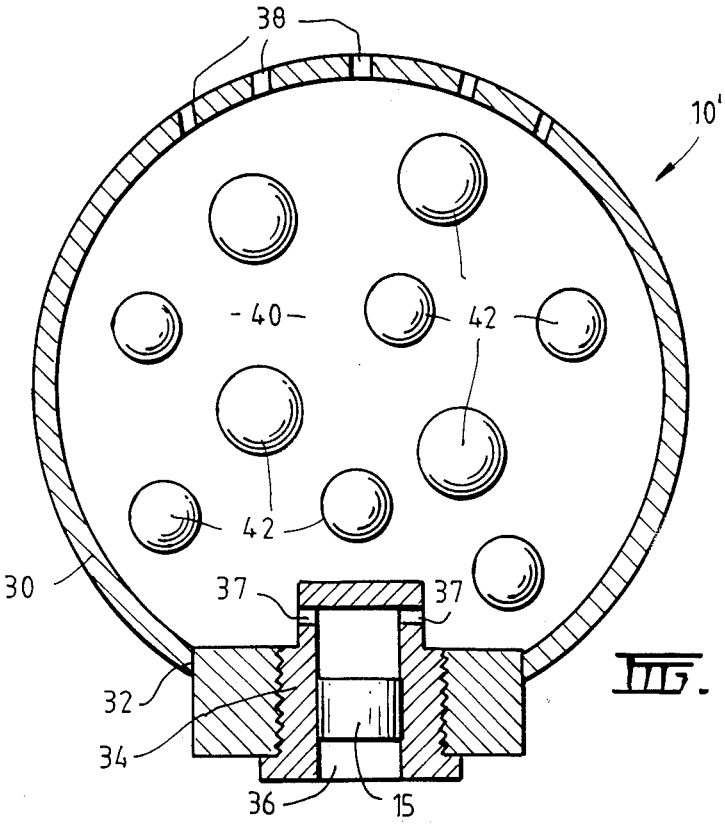
FIG. 6 is a cross-sectional view of the embodiment of FIG. 5.

FIGS. 5 and 6 show a further embodiment of the invention in which the spray device 10' is a generally spherical member 30. A hole 32 is formed in the spherical member 30 and an inlet diffuser 34 is located in the hole. The inlet diffuser 34 has an inlet 36 for connection to a supply of water and outlets 38 which are arranged generally at right angles to the axis of the inlet 36. Opposite the inlet diffuser 34 a plurality of apertures 38 are formed to enable water to exit a spray chamber 40 defined by the interior of the spherical member 30. The diffuser 34 may also include a pressure control valve 15.

The chamber 40 also accommodates a plurality of bodies 42 of different masses. The bodies 42 may be formed in the same manner as bodies described with reference to the embodiments of FIGS. 1 to 4. However, in this embodiment the bodies could be of different colours and the spherical member 30 could be transparent so that the spray device 10' can be arranged in such a manner that it can be viewed. As well as a continually changing spray pattern emanating from the apertures 38 a viewer will also be able to see the coloured bodies 42 circulating within spherical body 30.

Experimentation has shown that extremely interesting and continually changing spray patterns can be obtained with the embodiments of this invention. The bodies which circulate within the spray chambers of the preferred embodiments tend to block apertures 38 from time to time as well as disrupt the flow of water from the inlet to the apertures thereby providing a continually changing flow pattern from some apertures whilst spurts of water emanate from other apertures. The continually changing sprays of water which emanate from the apertures interact with one another to provide an extremely attractive continually changing spray pattern.

Since modification within the spirit and scope of the invention may readily be effected by persons skilled within the art, it is to be understood that this invention is not limited to the particular embodiment described by way of example hereinabove.

I claim:

1. A spray device, said spray device having an inlet communicating with a spray chamber, said spray chamber having a plurality of apertures for enabling water to be sprayed out from said spray chamber, said spray chamber accommodating a plurality of bodies and being sufficiently large compared to the size of the bodies so that the bodies circulate randomly within said chamber as water passes through the chamber from the inlet to the plurality of apertures to randomly block apertures of said plurality of apertures to thereby disrupt the flow of water through the chamber and cause a continually changing spray pattern to be sprayed from said apertures.

2. The spray device of claim 1 wherein the plurality of bodies have different masses.

3. The spray device according to claim 2 wherein the bodies comprise ball bearings of different sizes to thereby provide the plurality of bodies having different masses.

4. The spray device according to claim 2 wherein the bodies are of the same size and made from different materials to provide the plurality of bodies having different masses.

5. The spray device of claim 1 wherein the plurality of apertures are formed in an upper wall of the spray device and said upper wall is convex with respect to the outside.

6. The spray device according to claim 1 wherein a pressure control valve is provided in said inlet.

* * * * *